US007137378B1

(12) United States Patent
Jaeger et al.

(10) Patent No.: US 7,137,378 B1
(45) Date of Patent: Nov. 21, 2006

(54) COMPONENT MOUNTING SYSTEM FOR A MARINE ENGINE

(75) Inventors: Matthew W. Jaeger, Stillwater, OK (US); William C. Martin, Edmond, OK (US); Jerry M. Stoll, Jr., Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/119,836

(22) Filed: May 2, 2005

(51) Int. Cl.
*F02M 35/10* (2006.01)

(52) U.S. Cl. ..... 123/198 D; 123/198 E

(58) Field of Classification Search ..... 123/198 D, 123/198 E
See application file for complete search history.

(56) References Cited

U.S. PATENT DOCUMENTS 3,954,092 A * 5/1976 Polaner ..... 123/198 D
4,268,289 A 5/1981 Polaner ..... 55/486
4,893,591 A * 1/1990 Nelson ..... 123/184.31
5,203,296 A * 4/1993 Hart ..... 123/198 D
5,357,913 A 10/1994 Okumura et al. ..... 123/184.34
5,709,187 A * 1/1998 Jaeger et al. ..... 123/198 D
5,794,707 A 8/1998 Alhamad ..... 169/69

* cited by examiner

*Primary Examiner*—Stephen K. Cronin
*Assistant Examiner*—Jason Benton
(74) *Attorney, Agent, or Firm*—William D. Lanyi

(57) ABSTRACT

An attachment and support system is provided for supporting a flame arrestor and cover at a preselected position relative to a throttle body which, in turn, is attached to an air intake manifold. A support member is attached, by four bolts, to the air intake manifold. The four bolts, or alternative attachment components, simultaneously attach the throttle body to the air intake manifold and the support member to the throttle body. Both the flame arrestor and cover are attached, by a stud, to the support member.

17 Claims, 5 Drawing Sheets

COMPONENT MOUNTING SYSTEM FOR A MARINE ENGINE

BACKGROUND OF THE INVENTION

1. Field of the Invention

The present invention is generally related to a component mounting system and, more particularly, to an arrangement which supports a flame arrestor and a cover on a throttle body structure and the intake manifold of a marine engine.

2. Description of the Related Art

Those skilled in the art of marine engine design are familiar with various types of flame arrestors that are used in conjunction with engines of all types and, in particular, engines used in conjunction with marine propulsion systems.

U.S. Pat. No. 5,203,296, which issued to Hart on Apr. 20, 1993, describes a flame arrestor having a helical flame arresting member. The arrestor comprises a continuous flame arresting member in the form of a helix having offset interstices between adjacent turns of the helix. The flame arrestor further comprises a mechanism for housing the flame arrestor member. Upon installation of the flame arrestor on a carburetor, air intake system, or any source of flammable gases, any backfire or flame passing through the flame arrestor will be extinguished.

U.S. Pat. No. 4,268,289, which issued to Polaner on May 19, 1981, describes a flame arresting air filter element. The element is intended for use with an air intake system and has an outer ring of pleated filtering paper and an inner, concentric ring formed of expanded metal foil, longitudinally stretched and laterally compressed so as to be adapted to diffuse and quench flames resulting from engine backfire. The inner ring is coated with a relatively inert, cohesive substance to provide a unitary structure. The two rings are provided with resilient end caps.

U.S. Pat. No. 5,709,187, which issued to Jaeger et al. on Jan. 20, 1998, discloses a flame arrestor. The flame arrestor is for a marine engine and includes an air box mounted to the combustion air intake, and a uniplanar flame arresting element mounted to the air box and passing combustion air therethrough in a first direction into the air intake and blocking flame propagation in a second opposite direction out of the air intake. Air flow from the flame arresting element to the air intake is rectilinear.

U.S. Pat. No. 5,357,913, which issued to Okumura et al. on Oct. 25, 1994, describes a flame arrestor arrangement for a marine propulsion engine. A pair of embodiments of flame arrestor arrangements for marine propulsion engines are described wherein the flame arrestor is positioned vertically above the thermostat housing at one end of the engine and the plenum chamber for the intake is manifold is disposed above the exhaust elbow of the engine so as to provide good induction efficiency and compact size. Different configurations of flame arrestors are disclosed and they provide large effective inlet areas and, at the same time, good flame protection.

U.S. Pat. No. 5,794,707, which issued to Alhamad on August 18, 1998, describes a flame arrestor. An efficient flame arrestor is adapted for use in preventing an external flame from backflashing upstream in a pipe, or a conduit, or a stream carrying a flammable substance. The flame arrestor comprises a contained layer of nested spheroids formed from expanded metal sheets made from magnesium alloy foil. The arrestor is useful in fuel tanks, combustion systems, seagoing tankers, hot water or space heaters, and the like.

The patents described above are hereby expressly incorporated by reference in the description of the present invention.

It would be significantly beneficial if an improved mounting method could be provided in which a flame arrestor is robustly supported by a throttle body and intake manifold in such a way that it is easily removable from the throttle body. In addition, it would be significantly beneficial if a cover could be supported over the flame arrestor by the same structure which attaches the flame arrestor to the throttle body. It would be also significantly beneficial if a structure could be provided that maintains the flame arrestor and the throttle body in a coaxially aligned relationship during operation of a marine engine.

SUMMARY OF THE INVENTION

A component mounting system for a marine engine, made in accordance with a preferred embodiment of the present invention, comprises a throttle body structure, a support member removably attached to the throttle body structure at a plurality of attachment locations of both the throttle body structure and the support member, a flame arrestor attached to the support member, and a cover attached to the support member.

A preferred embodiment of the present invention can further comprise a stud which is attached to the support member and which extends through the flame arrestor and the cover. The present invention can further comprise a seal member disposed between an outer circumferential surface of the throttle body and an inner circumferential surface of the support member. The seal member is configured to align the inner circumferential surface in coaxial relation with the outer circumferential surface. The stud is threaded into a hole in a support member in a particularly preferred embodiment of the present invention. The support member can be attached to the throttle body by a plurality of threaded devices which, in turn, can comprise a plurality of bolts extending through clearance holes formed in the support member and in the throttle body.

A nut can be threadingly attached to the stud to retain the flame arrestor in place relative to the support member. An attachment cap can be threadingly attached to the stud to retain the cover in place relative to the support member. By maintaining the support member and the throttle body in coaxial relation with each other, the presence of air restricting edges can be minimized or eliminated. These edges, if they are allowed to exist, can deleteriously affect the flow of air through the throttle body and, in certain cases, result in a disadvantageous noise as air flows through the throat of the throttle body.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
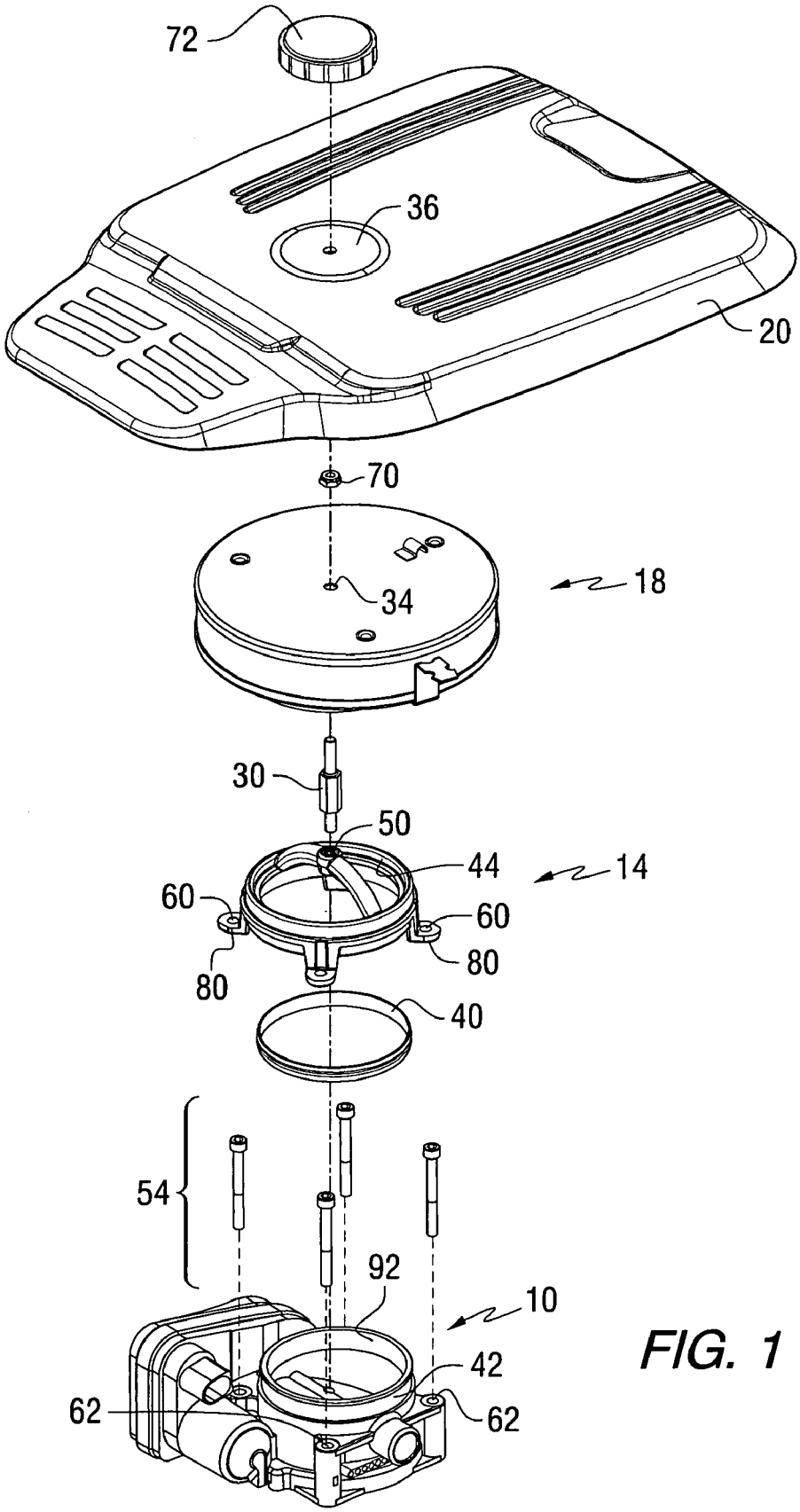
FIG. 1 is an exploded isometric view of the present invention.

Throughout the description of the preferred embodiment of the present invention, like components will be identified by like reference numerals.

Figure 2:
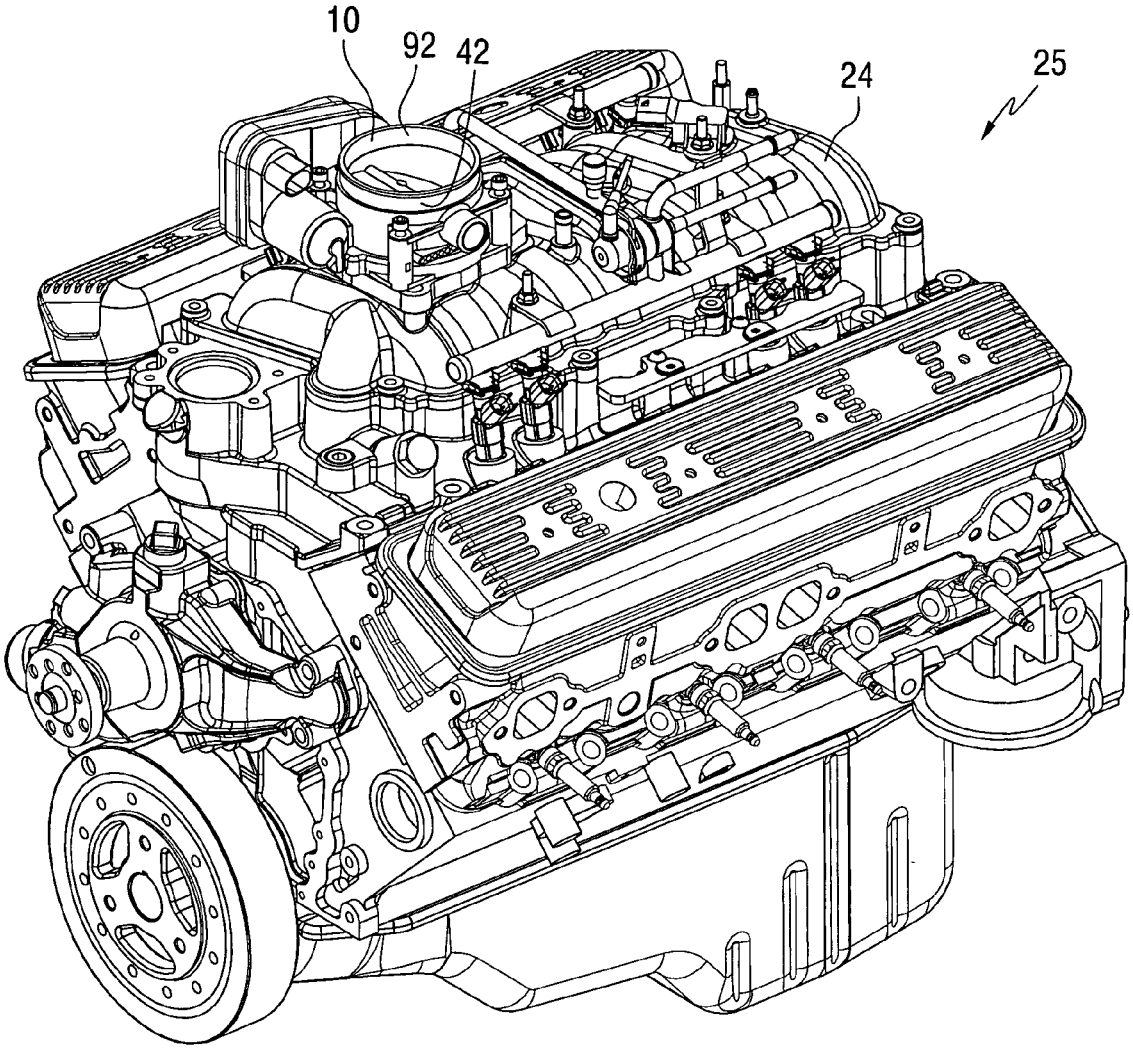
FIG. 2 shows a throttle body attached to an air intake manifold of an engine.

FIGS. 1 and 2 are isometric views of portions of a marine engine system incorporating the present invention. FIG. 1 is an exploded view showing a throttle body 10, a support member 14, a flame arrestor 18, and an engine cover 20, along with associated components. FIG. 2 shows the throttle body 10 in association with an air intake manifold 24 and an engine 25.

With continued reference to FIGS. 1 and 2, the support member 14 is removably attached to the throttle body 10 at a plurality of attachment locations of both the throttle body structure 10 and the support member 14. A stud 30 is attached to the support member 14 and extends through a hole 34 in the flame arrestor 18 and a hole 36 formed in the cover 20.

With continued reference to FIGS. 1 and 2, a seal member 40 is disposed between an outer circumferential surface 42 of the throttle body structure 10 and an inner circumferential surface 44 of the support member 14. The seal member 40 is configured to align the inner circumferential surface 44 in coaxial relation with the outer circumferential surface 42 when the support member 14 is placed on the throttle body structure 10 with the seal member 40 therebetween. It should be understood that the seal member 40 is not required for the purpose of preventing a backfire situation. Instead, its primary function is as an alignment tool which aligns the support member 14 with respect to the throttle body structure 10. In addition, the seal member 40 is symmetrical about its central axis and therefore does not required orientation during the assembly process.

In a preferred embodiment of the present invention, the stud 30 is threaded into a hole 50 in the support member 14. The support member 14 is attached to the throttle body structure 10 by a plurality of threaded devices 54, such as bolts. The bolts 54 extend through clearance holes 60 formed in the support member 14 and through clearance holes 62 in the throttle body structure 10. The bolts 54 are threaded into holes in the intake manifold 24. A nut 70 is threadingly attached to the stud 30 to retain the flame arrestor 18 in place relative to the support member 14. An attachment cap 72 is threadingly attached to the stud 30 to retain the cover 20 in place relative to the support member 14.

Figure 3:
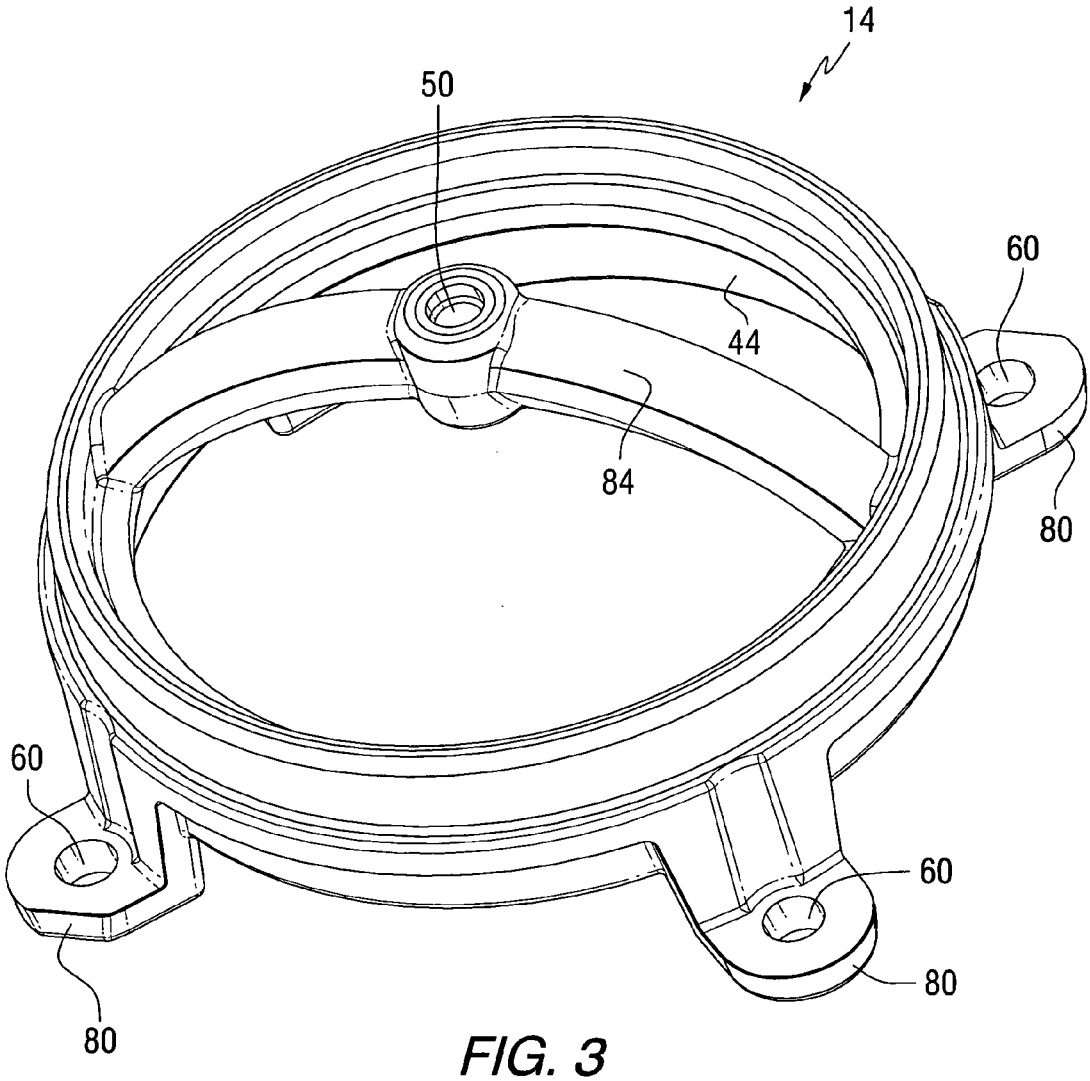
FIG. 3 shows an isometric view of the support member.

FIG. 3 is an isometric view of the support member 14. In a preferred embodiment of the present invention, the support member 14 is provided with four feet 80 through which clearance holes 60 are formed. These clearance holes 60 allow the bolts 54 to pass therethrough and be threaded into the air intake manifold 24 described above in conjunction with FIG. 2. A bridging member 84 is formed as a portion of the support member 14 and the threaded hole 50 is formed in the bridging member 84. The four feet 80 allow the support member 14 to be rigidly, but removably, attached to the throttle body structure 10 and intake manifold 24 to provide a robust support for both the flame arrestor 18 and the cover 20. However, compared to known attachment methods, the combination of the clearance holes 60, the feet 80 and the bolts 54 allow easier removal of the support member 14 from the throttle body structure 10 and intake manifold 24. Previous methods of attaching a flame arrestor 18 to a throttle body structure 10 typically include the use of hose clamps. The hose clamps often did not assure a robust attachment of the flame arrestor 18 to the throttle body structure.

Figure 4:
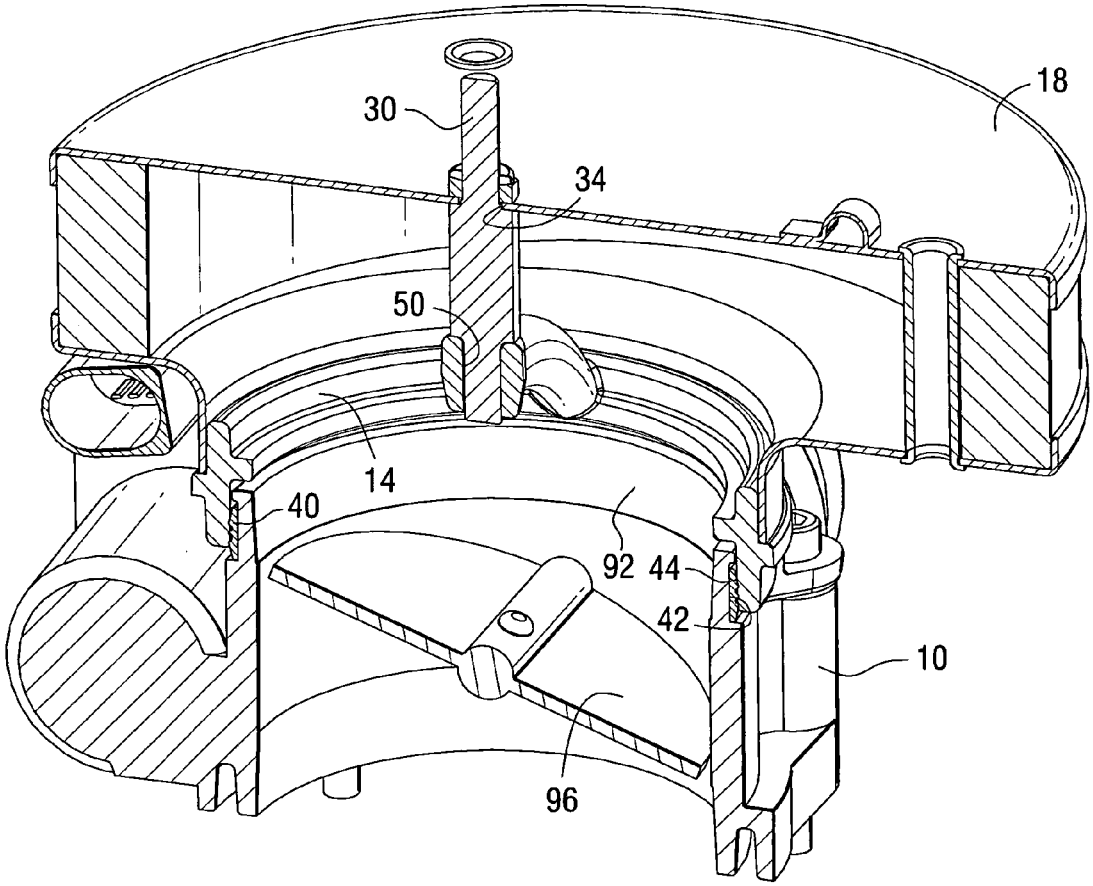
FIG. 4 is a section view through a throttle body, the support member of the present invention, and a flame arrestor.

FIG. 4 is a section view of the throttle body 10 with the flame arrestor 18 attached thereto. The support member 14 is provided with an inner circumferential surface 44 that is shaped to be assembled over an outer circumferential surface 42 of the throttle body 10. Between the inner and the outer circumferential surfaces, 44 and 42, a seal member 40 is disposed. The seal member, when assembled over the outer circumferential surface 42 of the throttle body structure 10, aligns the inner circumferential surface 44 with the outer circumferential surface 42. This, in turn, aligns the support member 14 in coaxial relation with the throat 92 of the throttle body structure 10. The stud 30 is shown threaded into the hole 50 of the support structure 14 and disposed through the hole 34 of the flame arrestor 18. Also shown in FIG. 4 is the throttle plate 96 of the throttle body structure 10. It should be understood that, depending on the type of marine engine used in conjunction with the present invention, the throttle body structure 10 can be a portion of a carburetor. In certain types of fuel injected engines, the throttle body structure 10 is not a carburetor but, instead, functions to direct air into an air intake manifold 24 where fuel is injected into the air stream.

Figure 5:
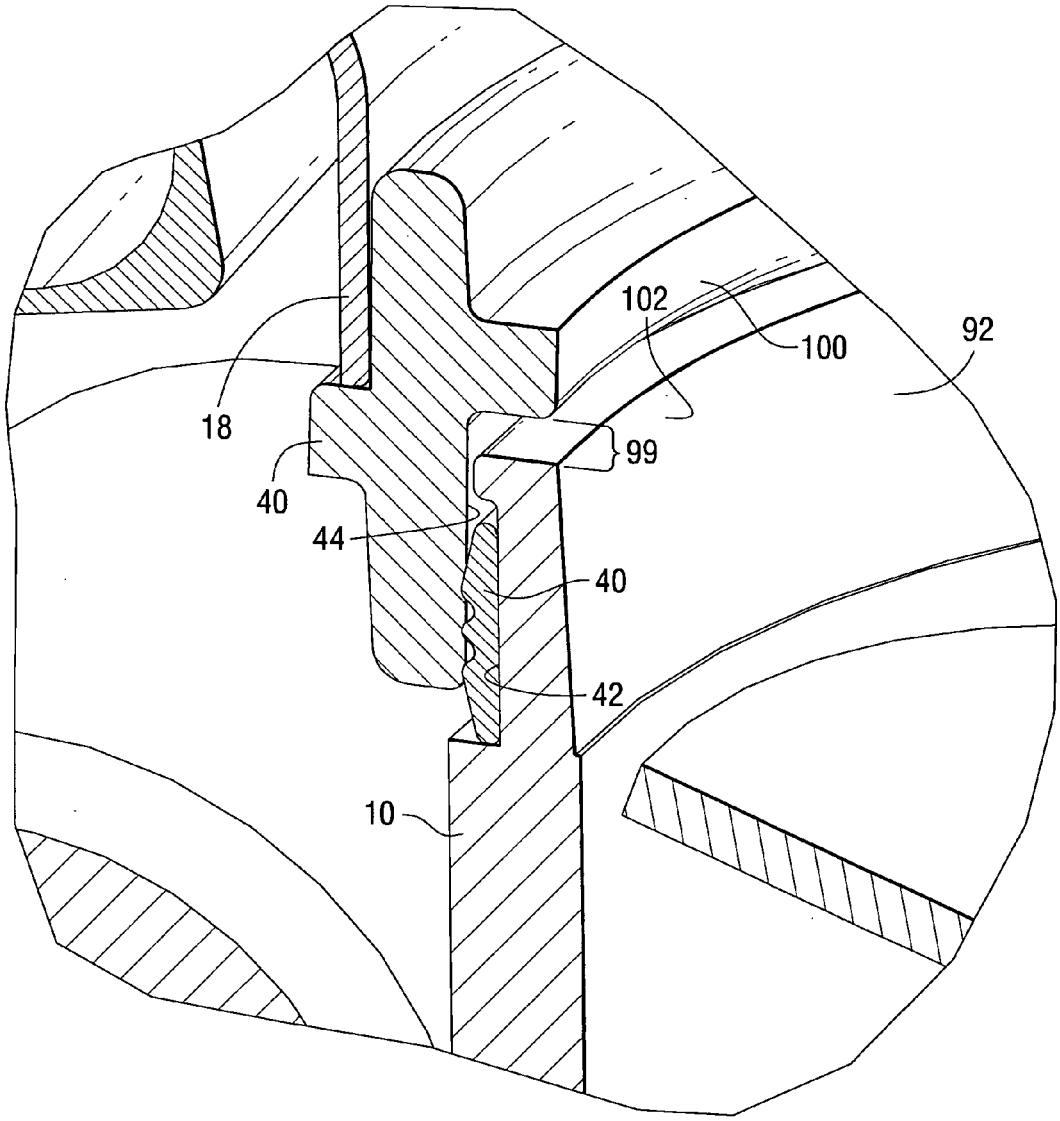
FIG. 5 is an enlarged section view of a portion of the illustration shown in FIG. 4.

FIG. 5 is an enlarged section view of a portion of the structure shown in FIG. 4. The seal member 40 is shown disposed between the outer circumferential surface 42 of the throttle body 10 and the inner circumferential surface 44 of the support member 40. The uniform thickness of the seal member 40 serves to align the support member 40 in coaxial relation with the cylindrical surface of the throat 92 of the throttle body structure 10.

With continued reference to FIG. 5, it can be seen that the components are shaped in such a way that a clearance 99 is maintained when the bolts 54 are tightened. In addition, the seal member 40 serves to maintain the cylindrical surface 100 of the support member 40 in coaxial relation with the cylindrical surface 102 of the throat 92 of the throttle body structure 10.

With continued to FIGS. 1–5, it can be seen that a preferred embodiment of the present invention provides a component mounting system for a marine engine that performs several advantageous functions. It allows a flame arrestor 18 and a cover 20 to be rigidly and robustly attached to a throttle body structure 10 and intake manifold 24 in a way that facilitates the easy removal of those components. A support member 14 is provided with feet 80 that have clearance holes 60 formed therethrough. This allows the support member 14 to be rigidly bolted to threaded holes in the intake manifold 24. A seal member 40 performs several advantageous functions. First, it provides a seal between an outer circumferential surface 42 of the throttle body 10 and an inner circumferential surface 44 of the support member 14. In addition, it aligns the support member 14 with the throttle body 10 in such a way that the inner and outer circumferential surfaces, 44 and 42, are maintained in a coaxial relationship with each other.

Although the present invention has been described in particular detail and illustrated to show a preferred embodiment, it should be understood that alternative embodiments are also within its scope.

We claim:

1. A component mounting system for a marine engine, comprising:

a throttle body structure;

a support member removably attached to said throttle body structure at a plurality of attachment locations of both said throttle body structure and said support member;

a flame arrestor attached to said support member;

a cover attached to said support member; and a stud which is attached to said support member, said stud extending through said flame arrestor and said cover.

2. The mounting system of claim 1, further comprising:

a seal member disposed between an outer circumferential surface of said throttle body structure and an inner circumferential surface of said support member.

3. The mounting system of claim 2, wherein:

said seal member being configured to align said inner circumferential surface in coaxial relation with said outer circumferential surface.

4. The mounting system of claim 1, wherein:

said stud is threaded into a hole in said support member.

5. The mounting system of claim 1, wherein:

said support member is attached to said throttle body structure by a plurality of threaded devices.

6. The mounting system of claim 5, wherein:

said plurality of threaded devices comprise a plurality of bolts extending through clearance holes formed in said support member and said throttle body structure and into threaded holes in an air intake manifold.

7. The mounting system of claim 1, further comprising:

a nut threadingly attached to said stud to retain said flame arrestor in place relative to said support member.

8. The mounting system of claim 1, further comprising:

an attachment cap threadingly attached to said stud to retain said cover in place relative to said support member.

9. A component mounting system for a marine engine, comprising:

a throttle body structure;

a support member removably attached to said throttle body structure at a plurality of attachment locations of both said throttle body structure and said support member;

a flame arrestor attached to said support member;

a cover attached to said support member; and a stud attached to said support member, said stud extending through said flame arrestor and through said cover.

10. The mounting system of claim 9, further comprising:

a seal member disposed between an outer circumferential surface of said throttle body structure and an inner circumferential surface of said support member, said seal member being configured to align said inner circumferential surface in coaxial relation with said outer circumferential surface.

11. The mounting system of claim 10, wherein:

said support member is attached to said throttle body structure by a plurality of threaded devices.

12. The mounting system of claim 11, wherein:

said plurality of threaded devices comprise a plurality of bolts extending through clearance holes formed in said support member and said throttle body structure and into threaded holes in an air intake manifold.

13. The mounting system of claim 12, further comprising:

a nut threadingly attached to said stud to retain said flame arrestor in place relative to said support member; and an attachment cap threadingly attached to said stud to retain said cover in place relative to said support member.

14. A component mounting system for a marine engine, comprising:

a throttle body structure;

a support member removably attached to said throttle body structure at a plurality of attachment locations of both said throttle body structure and said support member by a plurality of threaded devices; and a flame arrestor attached to said support member;

a cover attached to said support member; and a stud attached to said support member, said stud extending through said flame arrestor and through said cover.

15. The mounting system of claim 14, further comprising:

a seal member disposed between an outer circumferential surface of said throttle body structure and an inner circumferential surface of said support member, said seal member being configured to align said inner circumferential surface in coaxial relation with said outer circumferential surface.

16. The mounting system of claim 14, wherein:

said plurality of threaded devices comprise a plurality of bolts extending through clearance holes formed in said support member and into threaded holes in an air intake manifold.

17. The mounting system of claim 14, further comprising:

a nut threadingly attached to said stud to retain said flame arrestor in place relative to said support member; and an attachment cap threadingly attached to said stud to retain said cover in place relative to said support member.

* * * * *